US009625153B2

(12) United States Patent
Beran et al.

(10) Patent No.: US 9,625,153 B2
(45) Date of Patent: Apr. 18, 2017

(54) LOW CALORIFIC FUEL COMBUSTOR FOR GAS TURBINE

(71) Applicants: Martin Beran, Prague (CZ); Axel Lars-Uno Eugen Axelsson, Hengelo (NL)

(72) Inventors: Martin Beran, Prague (CZ); Axel Lars-Uno Eugen Axelsson, Hengelo (NL)

(73) Assignee: OPRA TECHNOLOGIES B.V. (NL)

( * ) Notice: Subject to any disclaimer, the term of this patent is extended or adjusted under 35 U.S.C. 154(b) by 310 days.

(21) Appl. No.: 14/465,137

(22) Filed: Aug. 21, 2014

(65) Prior Publication Data

US 2014/0360195 A1 Dec. 11, 2014

Related U.S. Application Data

(63) Continuation-in-part of application No. 12/926,321, filed on Nov. 9, 2010, now Pat. No. 8,844,260.

(51) Int. Cl.
*F23R 3/06* (2006.01)
*F23R 3/00* (2006.01)
(Continued)

(52) U.S. Cl.
CPC ..... *F23R 3/002* (2013.01); *F23R 3/04* (2013.01); *F23R 3/06* (2013.01); *F23R 3/28* (2013.01);
(Continued)

(58) Field of Classification Search
CPC .... F23R 3/002; F23R 3/54; F23R 3/04; F23R 3/06; F23R 3/10; F23R 3/14;
(Continued)

(56) References Cited

U.S. PATENT DOCUMENTS 4,339,925 A * 7/1982 Eggmann ..... F01D 25/26 60/757
6,134,877 A * 10/2000 Alkabie ..... F23R 3/002 60/748
(Continued)

FOREIGN PATENT DOCUMENTS

DE 10 2009 025 795 A1 11/2009
EP 0 204 553 A1 10/1986
EP 1 517 088 A2 3/2005

OTHER PUBLICATIONS

PCT International Search Report and Written Opinion for International Application No. PCT/IB2011/003030, dated Jun. 5, 2013.

*Primary Examiner* — Andrew Nguyen
(74) *Attorney, Agent, or Firm* — Finnegan, Henderson, Farabow, Garrett & Dunner, L.L.P.

(57) ABSTRACT

A low calorific value fuel-fired can combustor for a gas turbine include a generally cylindrical housing, and a generally cylindrical liner disposed coaxially within the housing to define with the housing a radial outer flow passage for combustion air, the liner also defining inner primary and intermediate regions of a combustion zone and a dilution zone, the dilution zone being axially distant a closed housing end relative to the combustion zone. A nozzle assembly disposed at the closed housing end includes an air blast nozzle and surrounding swirl vanes. An impingement cooling sleeve coaxially disposed in the combustion air passage between the housing and the liner impingement cools the portion of the liner defining the combustion zone. A portion of the combustor air is introduced directly into the intermediate region.

11 Claims, 4 Drawing Sheets

(51) Int. Cl.
*F23R 3/28* (2006.01)
*F23R 3/04* (2006.01)
*F23R 3/54* (2006.01)

(52) U.S. Cl.
CPC ..... *F23R 3/54* (2013.01); *F05D 2260/201* (2013.01); *F23R 2900/00002* (2013.01); *F23R 2900/03044* (2013.01)

(58) Field of Classification Search
CPC .. F23R 2900/03043; F23R 2900/03044; F23R 2900/03282; F05D 2260/201
See application file for complete search history.

(56) References Cited

U.S. PATENT DOCUMENTS 6,314,716 B1 * 11/2001 Abreu ..... F23R 3/26 60/39.23
6,405,536 B1 6/2002 Ho
7,975,487 B2 * 7/2011 Lockyer ..... F23R 3/002 60/740
8,127,553 B2 * 3/2012 Ekkad ..... F23R 3/06 165/908
2004/0261419 A1 * 12/2004 McCaffrey ..... F23M 5/04 60/796
2009/0120094 A1 * 5/2009 Norster ..... F23R 3/002 60/752
2009/0282833 A1 11/2009 Hessler et al.
2010/0126174 A1 * 5/2010 Brinkmann ..... F23R 3/002 60/737
2010/0251723 A1 10/2010 Chen et al.
2011/0107766 A1 * 5/2011 Davis, Jr. ..... F23R 3/005 60/755
2012/0111012 A1 * 5/2012 Axelsson ..... F23R 3/14 60/737
2012/0144834 A1 * 6/2012 El Masalme ..... F23R 3/002 60/754

* cited by examiner

LOW CALORIFIC FUEL COMBUSTOR FOR GAS TURBINE

RELATED APPLICATIONS

This application is a continuation-in-part of application Ser. No. 12/926,321, filed on Nov. 9, 2010, the disclosure of which is incorporated herein by reference.

FIELD OF THE INVENTION

The present invention relates to can combustors for gas turbines. In particular, the present invention relates to low calorific liquid and gaseous fuel-fired, impingement cooled can combustors for gas turbine engines.

BACKGROUND OF THE INVENTION

A principle problem with fuels of a relatively low calorific value, e.g., 25 MJ/kg, or less is the lower flame speed that can adversely affect the completion of combustion, particularly for uneven fuel/air mixtures, thus affecting the local fuel/air ratio in the combustor. This problem is particularly pronounced in the case of liquid fuels, where the fuel/air mixtures may have large fuel particle (droplet) sizes, which increase the time required to vaporize and burn the particles.

The achievement of low levels of oxides of nitrogen in combustors is closely related to flame temperature and its variation through the early parts of the reaction zone. Flame temperature is a function of the effective fuel-air ratio in the reaction zone which depends on the applied fuel-air ratio and the degree of mixing achieved before the flame front. These factors are obviously influenced by the local application of fuel and associated air and particularly the effectiveness of mixing.

The use of film cooling in these low flame temperature combustors generates high levels of carbon monoxide emissions and eventually creates sediments. External impingement cooling of the flame tube (liner) can curtail such problems. Moreover, the requirement for stoichiometric combustion requires the air flow to the reaction zone be a small portion of the total air flow, and a large portion of the total air flow be available for the dilution zone. Hence there is a considerable advantage in controlling these flows to optimize the combustion efficiency and minimize the emissions.

Improvements are possible in the configuration of can combustors and in the control of air and air/fuel mixture flows in the can combustors using liquid fuel with a low calorific value, which flows affect the completeness of the burning, and thus the level of emissions and the thermal efficiency of the combustor. Such improvements are set forth hereinafter.

SUMMARY OF THE INVENTION

In an aspect of the present invention, a can combustor is configured for burning fuels with a low calorific value. The combustor includes a generally cylindrical housing having an interior, a longitudinal axis, an annular inlet for receiving compressed air at one longitudinal housing end with the other longitudinal housing end being closed. Also, a generally cylindrical combustor liner is coaxially disposed in the housing interior, the liner and the housing defining a generally annular flow passage for the compressed air received through the housing inlet, and the interior of the liner defining a combustion zone adjacent the closed housing end and a dilution zone distant the closed housing end. The liner is sized to have an L/D ratio of in the range $1 \leq L/D \leq 4$, where L is the liner length and D is the liner diameter, and to provide at a rated power, a ratio of the volume V of the combustion zone in meters$^3$ to the fuel energy flow rate Q in the combustor in MJ/sec in the range $0.009 \leq V/Q \leq 0.03$. A fuel nozzle assembly is disposed at the closed end, the nozzle assembly being supplied from a source of fuel having a calorific value of less than about 25 MJ/kg. Further, an impingement cooling sleeve is disposed in the compressed air passage surrounding the liner portion defining the combustion zone, the sleeve having a plurality of orifices sized and configured to impingement cool the outer surface of the liner portion. Essentially all of the compressed air received at the housing inlet may pass through the sleeve. A plurality of intermediate holes are circumferentially disposed in the liner for introducing a portion of the compressed air from the impingement cooling sleeve into the combustion zone, and a plurality of dilution openings is circumferentially disposed in the liner for introducing a second portion of the compressed air from the region downstream of the impingement cooling sleeve into the dilution zone. Still further, at least part of the remainder portion of the compressed air from the region downstream of the impingement cooling screen is channeled through the fuel nozzle assembly for mixing with the supplied fuel to provide a fuel/air mixture directed into the combustion zone.

While certain embodiments disclosed herein are described with respect to the usage of low-calorific fuels, e.g. fuels having a calorific value of 25 MJ/kg or less, such as pyrolysis oil and ethanol, the embodiments described herein are not limited to such fuels. Embodiments described herein may provide similar advantages when used with higher calorific fuels, such as diesel and heavy fuel oils.

The accompanying drawings, which are incorporated in and constitute a part of this specification, illustrate an embodiment of the invention and, together with the description, serve to explain the principles of the invention.

DESCRIPTION OF THE EMBODIMENT

Figure 1:
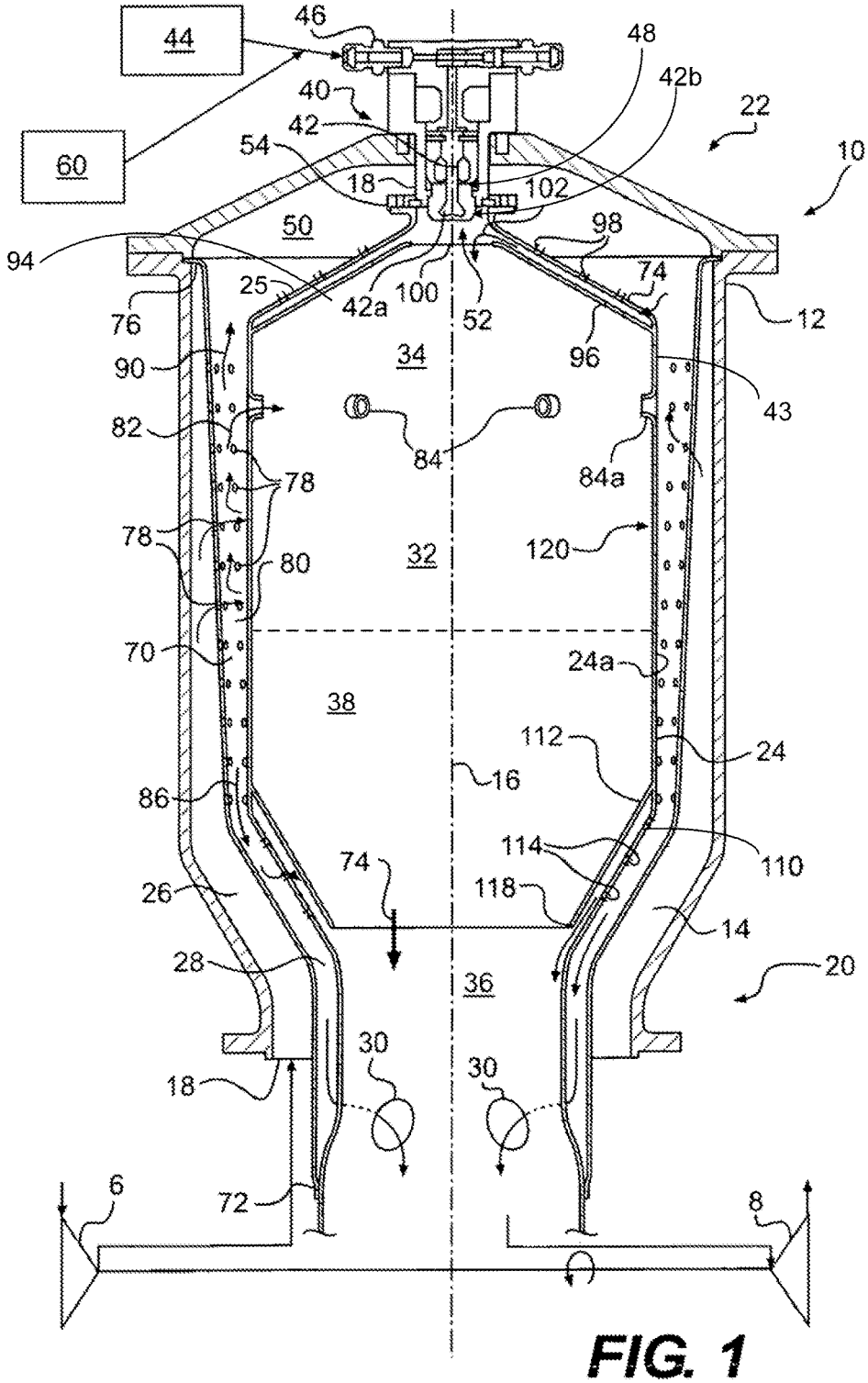
FIG. 1 is a schematic cross-sectional view of a gas turbine can combustor configured for combusting fuel having a low calorific value, in accordance with the present invention.

The can combustor of the present embodiment, generally designated by the numeral 10 in the figures, is intended for use in combusting fuel having a low calorific value fuel with compressed air from compressor 6, and delivering combustion gases to gas turbine 8, e.g., for work-producing expansion such as in a gas turbine engine. See FIG. 1. Compressor 6 may be a centrifugal compressor and gas turbine 8 may be a radial inflow turbine, but these are merely preferred and are not intended to limit the scope of the present invention, which is defined by the appended claims and their equivalents. Disclosure of this embodiment with respect to the usage of low calorific value fuel is not intended to be limiting. Aspects of the embodiment may also provide advantages when used with higher calorific value fuels.

In accordance with the present invention, as embodied and broadly described herein, the can combustor may include a generally cylindrical housing having an interior, a longitudinal, an annular inlet for receiving compressed air at one longitudinal end, axis with the other longitudinal end being closed. As embodied herein, and with reference to FIG. 1, can combustor 10 includes outer housing 12 having interior 14, longitudinal axis 16, annular inlet 18 configured to receive compressed air from compressor 6 at open housing end 20. Housing also includes closed end 22. Housing 12 is generally cylindrical in shape about axis 16, but can include tapered and/or stepped sections of a different diameter in accordance with the needs of the particular application and to accommodate certain features of the present invention to be discussed hereinafter.

In accordance with the present invention, the combustor also includes a generally cylindrical combustor liner coaxially disposed in the housing interior and configured to define with the housing a generally annular passage for the compressed air received through the inlet. The liner also defines respective radially inner volumes for a combustion zone and a dilution zone. The dilution zone is axially distant the closed housing end relative to the combustion zone, and the combustion zone is axially adjacent the closed housing end.

As embodied herein, and with continued reference to FIG. 1, combustor 10 includes combustor liner 24 disposed within housing 12 generally concentrically with respect to axis 16. Liner 24 may be sized and configured to define with housing 12 outer passage 26 for compressed air supplied from engine compressor 6 through inlet 18, to be used for impingement cooling, and thereafter combustion air and dilution air. Liner 24 also partially defines dilution air path 28. In the FIG. 1 embodiment, path 28 for the dilution air includes a plurality of dilution ports 30 distributed about the circumference of liner 24. Liner 24 includes a front wall 25. Front wall 25 may be positioned at an angle to the generally cylindrical walls of liner 24.

Interior 14 of liner 24 defines combustion zone 32 axially adjacent closed end 22, where compressed air and fuel are combusted to produce hot combustion gases. In conjunction with fuel nozzle assembly 40 disposed at closed end 18 (to be discussed hereinafter), liner 24 is configured to provide stable recirculation promoting primary combustion in recirculation region 34 of combustion zone 32, in a manner known to those skilled in the art. Combustion zone 32 may further include an intermediate region 38 for secondary combustion. Recirculation region 34 may be located more distally from the closed end 22 of combustor 10 than intermediate region 38. The interior of liner 24 further defines dilution zone 36 where combustion gases are mixed with dilution air from dilution ports 30 to lower the temperature of the combustion gases, before work-producing expansion in turbine 8.

Figure 2A:
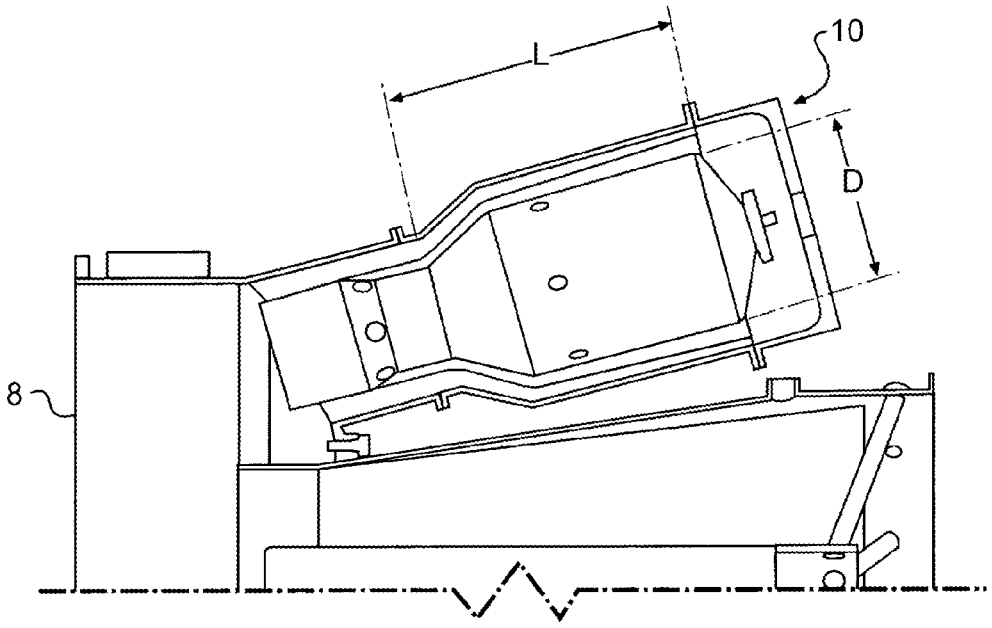
FIGS. 2A and 2B are schematic cross-sections comparing dimensions of the FIG. 1 combustor (FIG. 2A) with those of a prior art combustor (FIG. 2B) in a gas turbine engine application.
Figure 2B:
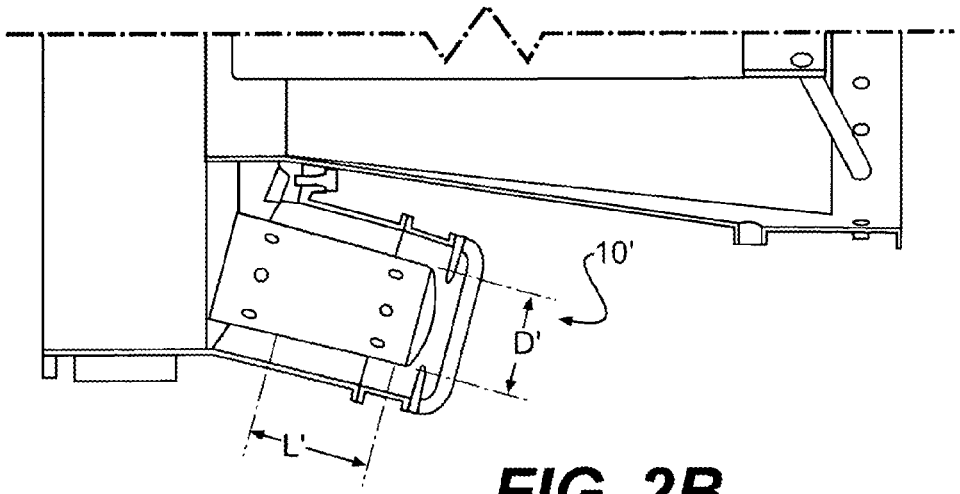
FIG. 2B (PRIOR ART)

With reference now to FIGS. 2A and 2B, a distinguishing feature of the can combustors of the present invention includes the larger size of the combustion zone, compared to conventional can combustors configured to combust equivalent fuel flow rates. Specifically, liner 24 of can combustor 10 of the present invention has a volume approximately four (4) times that of conventional combustors 10' for approximately the same fuel flow at rated power. That is, liner 24, and consequently housing 12, have expanded dimensions for liner length L and/or liner diameter D in the region of combustion zone 32, to achieve an expanded combustion zone volume for an equivalent fuel mass flow at rated power. Specifically, the liner of the present invention may be configured to have a ratio of combustor zone volume V in cubic meters to the heat energy flow rate Q in MJ/sec at rated power in the range $0.009 \leq V/Q \leq 0.03$, where Q is defined as the calorific value of the fuel in MJ/kg multiplied by the fuel mass flow rate in kg/sec. This increase in combustion zone volume relative to conventional can combustors is expected to increase the average residence time of the fuel/air mixture and also promote vaporization of any fuel droplets when liquid fuel is utilized. Moreover, the liner L/D ratio of combustors constructed in accordance with the present invention may be in the range $1 \leq L/D \leq 4$, and preferably $1.5 \leq L/D \leq 2.5$.

Also in accordance with the present invention, the combustor includes a fuel nozzle assembly disposed at the closed housing end and configured to inject a spray of fuel into the combustion zone. The nozzle assembly may include a nozzle aligned along the liner axis for directing a spray of fuel through an opening into the combustion zone. The nozzle assembly may further include a fuel pre-filmer. The nozzle may be an "air blast" nozzle such as is known in the art, in which compressed air is used to "atomize" liquid fuel to provide a spray, i.e. produce very small droplets between approximately 30 and 80 microns in diameter. In some embodiments, droplets of approximately 65 microns in diameter are suitable. Such an air blast nozzle also is usable with gaseous fuels to provide better mixing in combustor 10. The nozzle assembly also may have a plurality of swirl vanes circumferentially disposed about the nozzle to induce a swirling flow pattern of the fuel/air mixture. Further, the fuel nozzle assembly may be disposed coaxially with the liner.

In order to provide a fuel spray having the above-discussed droplet properties, an appropriate air distribution through the nozzle opening and the channels between swirl vanes 54 must be preserved. The atomization process in an air blast nozzle is split into two primary parts. First, primary break-up of the fuel occurs, and is influenced by the geometry of the air blast nozzle. Secondary, or final, break up then depends at least partially on an air flow pattern surrounding the nozzle. Thus, the ratio between air mass flow $M_{Nozzle}$ through the nozzle opening 48 and air mass flow $M_{Swirler}$ through the channels between the swirl vanes 54 is a key factor influencing the quality of the fuel spray. To achieve a fuel spray as described above, i.e. having droplets of approximately 65 microns in diameter, a ratio of $M_{Nozzle}/M_{Swirler}$ may be set in an inclusive range between 0.12 and 0.24.

A ratio between liner diameter D and a fuel pre-filmer outer diameter $D_P$ may be set in an inclusive range between 6 and 7. Further, in order to induce flame stabilization in recirculation region 34, an outlet diameter of the swirl vanes must be chosen appropriately with respect to the combustor liner 24 so as to generate a sufficiently strong recirculation region 34. A ratio of combustor liner diameter D to swirler outlet diameter $D_{Sw}$ between 2.4 and 2.8, inclusive, may provide appropriate airflow to generate a stable recirculation zone.

As embodied herein, and with attention to FIG. 1, nozzle assembly 40 includes air blast nozzle 42 and fuel pre-filmer 42*b* and is controllably supplied with low calorific fuel (liquid or gaseous) from source 44 through conduit 46. Nozzle 42 may be aligned along axis 16 and may include openings 48 for admitting compressed air from plenum region 50 between liner 24 and housing 12 at closed housing end 22, to the vicinity of nozzle tip 42*a*, which may be outwardly flared. When used with liquid fuels this nozzle assembly construction may achieve a very fine spray mist ("atomization") of the fuel and may provide significant vaporization and mixing prior to entry of the fuel/air mixture to recirculation region 34 of combustion zone 32 through nozzle assembly outlet 52.

Further, and with continued reference to FIG. 1, a plurality of swirl vanes 54 are disposed about the circumference of nozzle 42. Swirl vanes 54 are also fed by compressed air from plenum 50 and cause swirling of the fuel/air mixture leaving outlet 52 further increasing mixing and vaporization. Also, a second source 60 of fuel, such as an easily vaporized substance e.g. ethanol, may be provided to be mixed with fuel from source 44 to assist in combustion at part load, e.g. 60% or less of rated power. It may be preferred to mix the fuels upstream of nozzle assembly 40 as depicted in FIG. 1. One skilled in the art can provide appropriate valving and fuel controllers given the present disclosure. Alternatively, or additionally, air control apparatus, e.g., bleeding or variable geometry, may be employed to reduce the total air mass flow during such part load operation.

Still further in accordance with the present invention, as embodied and broadly described herein, the can combustor may further include an impingement cooling sleeve coaxially disposed in the compressed air passage between the housing and the combustor liner and surrounding at least the combustion zone. The impingement cooling sleeve may have a plurality of orifices sized and distributed to direct compressed air against the radially outer surface of the portion of the combustor liner defining the combustion zone, for impingement cooling. The impingement cooling sleeve may also extend further, extending past the combustion zone and into the dilution zone. Essentially all of the compressed air received at the housing inlet passes through the sleeve.

As embodied herein, and with reference again to FIG. 1, impingement cooling sleeve 70 is coaxially disposed between housing 12 and liner 24. Impingement cooling sleeve 70 extends axially along a portion of liner 24 from a location 72 downstream of dilution ports 30, relative to the general axial flow direction 74 of the combustion gases, to a location 76 on housing 12 adjacent closed end 22. Sleeve 70 includes a plurality of impingement cooling orifices 78 distributed circumferentially around sleeve 70 and configured and oriented to direct combustion air in passage 26 against the outer surface 24*a* of liner 24 in the vicinity of combustion zone 32. Cooling orifices may also be provided along the entire length of cooling sleeve 70, down to location 72, so as to provide impingement cooling to transition liner portion 110 and in the vicinity of dilution zone 36. Outer surface 24*a* of liner 24 may include side wall 43 and front wall 25. The space 80 between sleeve 70 and liner 24 comprises the downstream region for the compressed air flow after it has traversed sleeve 70 through impingement cooling orifices 78 and impingement cooled surface 24*a*.

As can best be seen in FIG. 1, the compressed air from sleeve downstream region 80 is channeled both in a direction 82 to provide combustion air for combustion zone 32 substantially through a plurality of primary holes 84, and also in a direction 86 to dilution air path 28, to provide dilution air substantially through dilution openings 30. Also, primary holes 84 can be configured with inwardly directed spout-shaped, wall extensions 84*a* to promote penetration into combustion zone 32.

It may also be preferred that plenum region 50 in the closed "head" end 22 of combustion housing 12 be supplied with compressed air from sleeve downstream region 80, and such is depicted in FIG. 1 by flow path 90. Noteworthy in the FIG. 1 embodiment is that the compressed air for air blast nozzle 42 is driven solely by the pressure differential between plenum 50 and the recirculation portion 34 of combustion zone 32. No separate supply of compressed air is required to operate nozzle 42, thereby simplifying the overall system, although the scope of the present invention in its broadest aspects is not so limited.

Still further, it may be preferred to use a portion of the compressed air in plenum 50 for impingement cooling of entrance portion 94 of liner 24. In the FIG. 1 embodiment, entrance portion 94 is conically tapered and includes inwardly spaced conical shield member 96. Suitably sized and directed orifices 98 are distributed around liner entrance portion 94 and directed to impingement cool shield 96, using compressed air from plenum 50. After cooling shield 96, the fraction of the compressed air from plenum 50, that is, the part not used to operate air blast nozzle 42, is admitted to region 34 of combustion zone 32 through liner inlet 100 along flow path 102, for use as combustion air.

It may yet be further preferred that a fraction of the dilution air flow be used to impingement cool a transition portion of the liner between the combustion zone and the dilution zone. In FIG. 1, transition liner portion 110 is conically tapered and converging in flow direction 74, and is provided with an inwardly spaced conical transition shield 112. A plurality of impingement cooling orifices 114 are distributed about transition liner portion 110, and are sized and directed to impingement cool transition shield 112 using a fraction of the compressed air flowing in dilution air passage 28. After cooling transition shield 112, the dilution air fraction is admitted to dilution zone 36 at transition shield exit 118.

In an alternative embodiment, cooling of transition liner 110 and dilution zone 36 may be provided by impingement sleeve 70. In such an embodiment, orifices 78 may be provided along an entire length of impingement sleeve 70, to location 72. In this embodiment, conical transition shield 112 and impingement cooling orifices 114 may be omitted.

Still further, it may be preferred to coat inner surface 120 of liner portion 24*a* with a thermal barrier coating ("TBC") to maintain high liner inner surface temperatures while preventing undue heat loss from combustion zone 32 and possible significant temperature deviations in the local combustion gas temperature near the liner wall from bulk average combustion zone values. The TBC coating also reduces the amount of sediment and unburned fuel on the liner inner surface. One skilled in the art would be able to select an appropriate TBC given the present disclosure.

In the embodiment depicted in FIG. 1, essentially all of the compressed air delivered through inlet 18 first passes through orifices 78 of impingement sleeve 70 to provide cooling for liner portion 24*a* and thereafter is admitted to combustion zone 32 as "combustion air" or to dilution zone 36 as "dilution air", that is, all except possibly unavoidable leakage. In an embodiment including orifices 78 extending an entire length of impingement sleeve 70, the compressed air delivered through inlet 18 may also provide direct cooling for transition liner portion 110.

In some embodiments, combustor 10 of the FIG. 1 embodiment may be configured such that, when combusting low calorific liquid fuels such as pyrolysis oil having a calorific value of about 18.7 MJ/kg, about 5-15% of the total compressed air mass flow from inlet 18 enters combustion zone 32 through primary ports 84, and that about 60-70% enters dilution zone 36 via dilution ports 30. As would be appreciated, the remainder portion (~15-35%) of the total mass flow of compressed air entering combustor inlet 18 is used for operation of air blast nozzle 42 and to impingement cool liner entrance shield 96 and/or liner transition shield 112. Also, in such an application the can combustor preferably would be configured with an L/D of about 1.65, and a V/Q of about $$0.0116\ \frac{m^3 \cdot sec}{MJ}.$$

The fuel mass flow rate at rated power in such an application would be about 0.09675 kg/sec and the combustion zone volume about 0.021 $m^3$.

Figure 3:
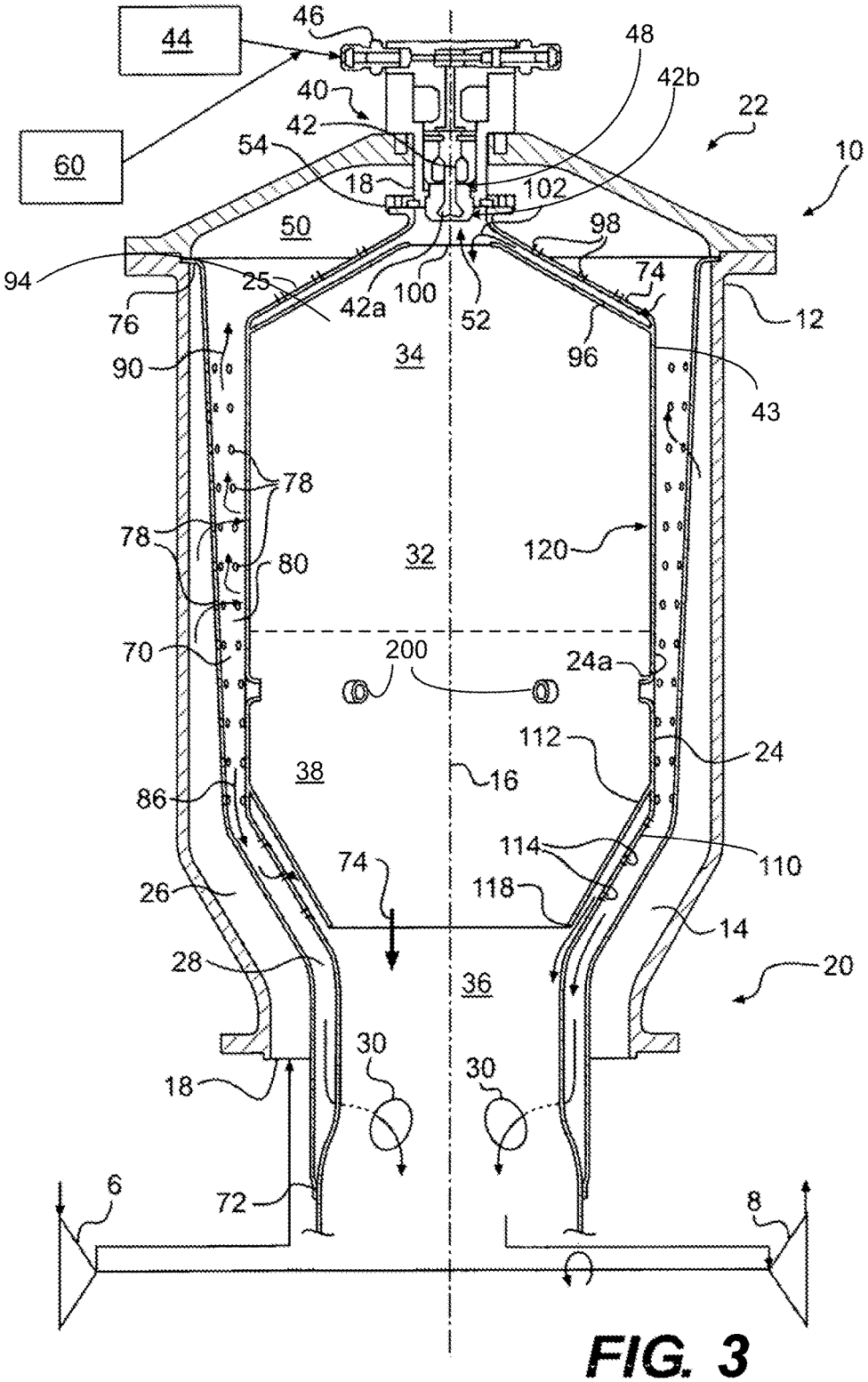
FIG. 3 is a schematic cross-sectional view of another embodiment of gas turbine can combustor configured for combusting fuel having a low calorific value and having intermediate holes configured to introduce compressed air into an intermediate region of a combustion zone.
Figure 4:
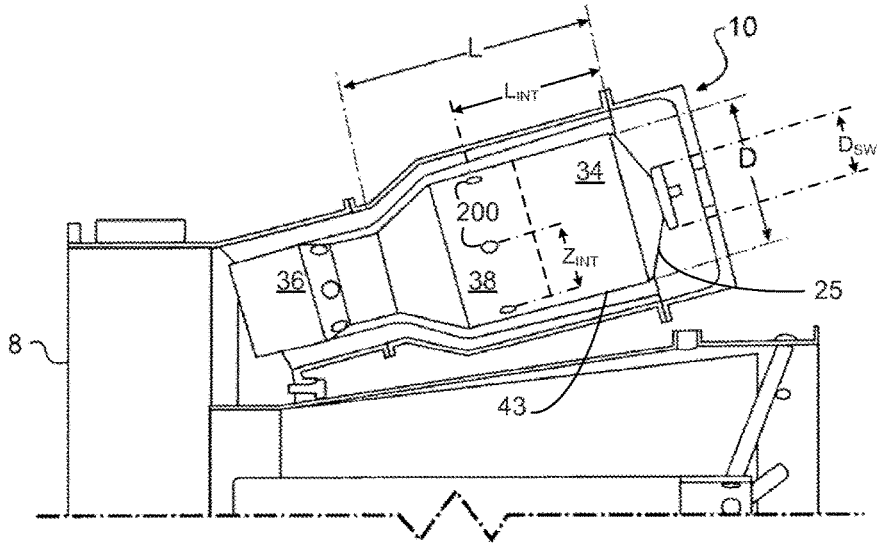
FIG. 4 is a schematic cross section illustrating the configuration of the combustor of FIG. 3.

In an alternative embodiment, as illustrated in FIGS. 3 and 4, intermediate holes 200 may be positioned in the combustor liner 24 so as to introduce a portion of the compressed air to an intermediate region 38 of combustion zone 32 to promote secondary combustion. This embodiment differs from that of FIGS. 1 and 2 in that intermediate holes 200 are not positioned to introduce compressed air into a recirculation region 34 to fuel primary combustion. Rather, intermediate holes 200 are positioned so as to introduce compressed air to intermediate region 38 to fuel a secondary combustion process occurring in the intermediate region 38. Providing additional compressed air at intermediate region 38 may serve to facilitate more complete combustion.

In such an embodiment, primary combustion may take place in recirculation region 34. The fuel/air mix admitted to combustion zone 32 at recirculation region 34 is further combined with air admitted through air blast nozzle 42 and orifices 98. The amount of air admitted into region 34 provides an air to fuel ratio rich enough to generate a sufficiently high combustion gas temperature so as to ensure stable burning even at idle and partial load conditions. Swirler 52 creates sufficient mixing in recirculation region so as to ensure continuous burning and ignition of the air/fuel mixture newly introduced to recirculation region 34. With a structure adapted to maintain such stable conditions at idle and partial load conditions, the air to fuel ratio may become too rich at full load conditions, resulting in incomplete burning of the fuel.

Completion of the burning process may be facilitated through the use of intermediate region 38. An additional portion of air may be introduced into intermediate region 38 of combustion zone 32 downstream of the recirculation region 34, in which primary combustion occurs, so as not to influence the gas flow in the recirculation zone. The air introduced into the intermediate region 38 may provide the oxygen required to complete the combustion process, so as to minimize or eliminate an amount of uncombusted fuel. Air introduced into intermediate region 38 may also lower the temperature inside region 38, which may adversely affect the final combustion process. Intermediate holes 200 may be configured for introduction of air into intermediate region 38 at flow rate that achieves a balance between providing additional oxygen required to complete combustion and ensuring that combustion temperatures remain high enough to prevent adverse effects on the combustion process.

Additionally, intermediate holes 200 may be configured such that air introduced into intermediate region 38 does not penetrate too deeply towards combustor axis 16. Flame stabilization may be achieved in recirculation region 34 through the swirling motion introduced by swirler 52. The swirling motion may serve to distribute combustion gases exiting recirculation region 34 circumferentially about combustor liner inner wall 120. Injecting air too deeply into intermediate region 38 may serve to disrupt the combustion gas distribution and introduce additional recirculation. In order to preserve the combustion gas distribution, intermediate holes 200 may be configured such that the portion of air introduced through them does not significantly disturb the combustion gas distribution exiting recirculation region 34 or the stabilized combustion process in recirculation region 34.

Furthermore, intermediate holes 200 may be configured to introduce air into intermediate region 38 so as to provide substantially uniform circumferential distribution of the air introduced through these holes.

Further details of a combustor 10 including intermediate holes 200 positioned to introduce air into an intermediate region 38 of combustion zone 32 are provided below with respect to FIGS. 3 and 4.

FIG. 3 is a schematic cross-sectional view of a gas turbine can combustor 10 configured for combusting fuel having a low calorific value and having intermediate holes 200 configured to introduce compressed air into an intermediate region 38 of a combustion zone 32. Combustor 10 as illustrated in the embodiment of FIG. 3 may be efficacious when combusting low calorific liquid fuels such as pyrolysis oil having a calorific value of approximately 18.7 MJ/kg. Disclosure of this embodiment with respect to the usage of low calorific value fuel is not intended to be limiting. Aspects of the embodiment may also provide advantages when used with higher calorific value fuels.

In order to achieve the combustion process discussed above, combustor 10 may be configured as follows. A first portion of compressed air, including about 5-20% of the total compressed air mass flow from inlet 18 may enter combustion zone 32 through swirl vanes 54. A second portion and a third portion of compressed air, together including 60-70% of the total compressed air mass flow from inlet 18 may enter dilution zone 36 via dilution ports 30 and intermediate holes 200. The second portion of compressed air introduced through intermediate holes 200 may be approximately 10-12% of the total compressed air mass flow. The third portion of the compressed air introduced through dilution ports 30 may be approximately 48-60% of the total compressed air mass flow. A remainder portion (~15-35%) of the total mass flow of compressed air entering combustor inlet 18 may include an injection portion to be channeled through air blast nozzle 42 and an additional portion used to impingement cool liner entrance shield 96 through orifices 98 and/or liner transition shield 112 through orifices 114.

The basic shape of combustor liner 24 may be defined by a ratio of length L to diameter D and by its volume V. For any required combustor load, a certain energy flow rate Q is required. The required energy flow rate Q of a given combustor is independent of fuel type. Various types of fuel, however, may mix and burn differently within combustion liner 24. In order to achieve optimal performance, combustion liner 24, and the various regions of combustion zone 32, may be sized and shaped to accommodate a selected fuel. In order to maintain scalability of a combustor design, it may be convenient to define the dimensions of the combustor with respect to the required flow rate Q.

In an embodiment designed for efficient combustion of low calorific fuels having calorific values of less than about 25 MJ/kg, e.g., pyrolysis oil, combustor liner 24 may be sized and shaped as follows. Combustor 10 may be configured with an L/D of about 1.65, and a V/Q of about $$0.0116\ \frac{m^3 \cdot sec}{MJ}.$$

The fuel mass flow rate at rated power in such a combustor may be about 0.09675 kg/sec and the combustion zone volume about 0.021 $m^3$. A person of skill in the art will recognize that a combustor requiring higher energy output will require a higher energy flow rate Q, and thus commensurately larger values of V, L, and D.

FIG. 4 illustrates dimensions of the combustor of FIG. 3. Combustor 10 of the embodiment of FIGS. 3 and 4 may have intermediate holes 200 positioned in combustor liner 24 surrounding intermediate region 38 of combustion zone 32, where intermediate region 38 is located distally of recirculation zone 34 and proximally of dilution zone 36 relative to combustor closed end 22. In order to ensure that compressed air introduced to combustor 10 at intermediate region 38 does not disturb the combustion process in recirculation region 34, intermediate holes must be sized and located to permit an appropriate amount of air to enter combustor 10 at an appropriate location. A ratio of liner diameter D to hole diameter $D_{INT}$ may be in an inclusive range between 27 and 29. A ratio of combustor length L to the shortest spatial distance $Z_{Int}$ along combustor liner 24, i.e. an arc length, between two consecutive intermediate holes 200 may be in an inclusive range between 4 and 5. Finally, a longitudinal position $L_{Int}$ of intermediate holes 200 may be defined as a distance between combustor liner front wall 25 and a centerline of intermediate holes 200. In some embodiments, e.g., as shown in FIG. 3, combustor liner front wall 25 may not be perpendicular to combustor liner outer wall 24*a*. In such an embodiment, $L_{Int}$ may be measured from the circumference at which combustor liner front wall 25 joins with side wall 43. A ratio between a combustor liner length L to intermediate hole longitudinal position $L_{Int}$ may be within an inclusive range between 0.6 and 0.7. When combustor 10 is operated with low-calorific fuels, as described herein, intermediate holes 200 sized and located according to the above-described dimensions may be capable of providing a suitable amount of compressed air to intermediate region 38 at a location suitable for assisting in the completion of fuel combustion without disturbing primary fuel combustion occurring in recirculation zone 34.

Combustor 10, as described above, may provide advantages when burning low-calorific fuel. The introduction of compressed air into an intermediate region 38 of combustion zone 32 may serve to facilitate more complete combustion, i.e., reducing or eliminating an amount of uncombusted fuel. t will be apparent to those skilled in the art that various modifications and variations can be made in the disclosed impingement cooled can combustor, without departing from the teachings contained herein. Although embodiments will be apparent to those skilled in the art from consideration of this specification and practice of the disclosed apparatus, it is intended that the specification and examples be considered as exemplary only, with the true scope being indicated by the following claims and their equivalents.

What is claimed is:

1. A can combustor for burning fuels with low calorific values, the combustor comprising:

a generally cylindrical housing having an interior, a longitudinal axis, an annular inlet for receiving compressed air at one open longitudinal housing end with the other longitudinal housing end being closed;

a generally cylindrical combustor liner coaxially disposed in the housing interior, the liner and the housing defining a generally annular flow passage for the compressed air received through the housing inlet, an interior of the liner defining a combustion zone adjacent the closed housing end and a dilution zone distant the closed housing end, the combustion zone including a recirculation region for primary combustion and an intermediate region for secondary combustion, wherein the recirculation region is more proximal to the closed housing end than the intermediate region;

a fuel nozzle assembly including a fuel nozzle disposed at the closed end, an impingement cooling sleeve disposed in the compressed air passage surrounding a liner portion defining the combustion zone, the sleeve having a plurality of orifices sized and configured to impingement cool an outer surface of the liner portion with essentially all of the compressed air received at the housing inlet passing through the sleeve;

a plurality of swirl vanes circumferentially disposed in the liner and configured to introduce a first portion of the compressed air from a region downstream of the impingement cooling sleeve into the recirculation region of the combustion zone in a swirling flow pattern;

a plurality of intermediate holes circumferentially disposed in the liner and configured to introduce a second portion of the compressed air from the region downstream of the impingement cooling sleeve into the intermediate region of the combustion zone, a plurality of dilution openings circumferentially disposed in the liner and configured to introduce a third portion of the compressed air from the region downstream of the impingement cooling sleeve into the dilution zone, wherein an injection part of a remainder portion of the compressed air from the region downstream of the impingement cooling screen is channeled through the fuel nozzle assembly for mixing with the low calorific fuel to form a fuel spray which is injected into the combustion zone through the nozzle;

wherein a primary combustion process occurring in the recirculation region of the combustion zone is stabilized by the first portion of compressed air introduced by the swirl vanes in a swirling flow pattern, and wherein a secondary combustion process occurring in the intermediate region of the combustion zone is effected by the second portion of the compressed air introduced to the intermediate region of the combustion zone through the intermediate holes downstream of the recirculation region.

2. The can combustor as in claim 1, wherein the liner is sized to have an LID ratio in the range $1.00 \leq L/D < 4.00$, where L is a liner length and D is a liner diameter, and to provide at a rated power a ratio of a combustion zone volume V in $m^3$ to a heat energy flow rate Q in MJ/sec in the range $$0.009 \leq V/Q \leq 0.03\ \frac{m^3 \cdot sec}{MJ}.$$

3. The can combustor as in claim 1 wherein the first portion of compressed air is 5-15% of a total compressed air mass flow rate.

4. The can combustor as in claim 1, wherein the second portion and third portion of compressed air together total 60-70% of a total compressed air mass flow rate.

5. The can combustor as in claim 4, wherein the second portion of compressed air is 10-12% of the total compressed air mass flow and the third portion of compressed air is 48-60% of the total compressed air mass flow.

6. The can combustor as in claim 1, wherein the fuel nozzle assembly includes a fuel pre-filmer having an outer diameter $D_P$ sized within a range of $6<D/D_P<7$, wherein D is a liner diameter.

7. The can combustor as in claim 6, wherein the fuel nozzle assembly is disposed coaxially with the liner and wherein the swirl vanes are distributed circumferentially about an exit of the nozzle assembly to induce swirling in a directed fuel/air mixture using another part of the remainder air portion, and wherein the swirl vanes have an outer diameter $D_{sw}$ sized within a range of $2.4<D/D_{sw}<2.8$, wherein D is a liner diameter.

8. The can combustor as in claim 1, wherein an air mass flow $M_{nozzle}$ nozzle through a nozzle opening to air mass flow $M_{swirl}$ through the swirl vanes is within a range $0.12<M_{nozzle}/M_{swirl}<0.24$.

9. The can combustor as in claim 1, wherein a ratio of liner diameter D to intermediate hole diameter $D_{INT}$ is $27<D/D_{INT}<29$, a ratio of combustor liner length L to the shortest spatial distance between two consecutive intermediate holes $Z_{INT}$ is in the range $4<L/Z_{INT}<5$, and a ratio of combustor liner length L to an intermediate hole longitudinal position $L_{INT}$ measured from a front wall of the combustor liner to a center line of the intermediate hole is in the range $0.6<L_{INT}/L<0.7$.

10. The can combustor as in claim 1, wherein a radially inner surface of the liner is coated with TBC to increase a liner inside surface temperature.

11. The can combustor as in claim 1, wherein substantially all of the compressed air entering the combustor is used to cool the combustor liner.

* * * * *